United States Patent [19]

Buchan et al.

[11] Patent Number: 5,012,291

[45] Date of Patent: Apr. 30, 1991

[54] POWDER TRANSPORT, FUSING AND IMAGING APPARATUS

[75] Inventors: William R. Buchan, Pocasset; Robert A. Moore, Waquoit; Wendell J. Caley, Jr., Quincy; Mark A. Gilmore, Allston; David M. Hudson, Chelmsford, all of Mass.

[73] Assignee: Delphax Systems, Randolph, Mass.

[21] Appl. No.: 355,994

[22] Filed: May 23, 1989

[51] Int. Cl.[5] ..... G03G 15/00

[52] U.S. Cl. ..... 355/271; 355/319

[58] Field of Search ..... 355/271, 274, 275, 279, 355/282, 285, 286, 288–290, 319, 212; 101/DIG. 37

[56] References Cited

U.S. PATENT DOCUMENTS

| | | | |
|---|---|---|---|
| 3,536,398 | 10/1970 | Bhagat | 355/319 X |
| 3,893,761 | 7/1975 | Buchan et al. . | |
| 3,923,392 | 12/1975 | Buchan et al. . | |
| 3,936,171 | 2/1976 | Brooke | 355/271 |
| 3,937,572 | 2/1976 | Gaynor et al. | 355/212 X |
| 3,940,210 | 2/1976 | Donohue | 355/319 X |
| 3,947,113 | 3/1976 | Buchan et al. . | |
| 4,427,285 | 1/1984 | Stange | 355/288 |

*Primary Examiner*—R. L. Moses

*Attorney, Agent, or Firm*—Lahive & Cockfield

[57] ABSTRACT

A transport member moves in a cyclic path to carry material from a first location to a second location at a different temperature, and a thermal shunt connects portions of the transport member. Counter-moving portions of the member are positioned to exchange heat with each other along an intermediate portion of the path, so that minimum energy is lost to the environment. In one embodiment as a printing apparatus, a belt transports a heat-fusible toner to a heater location where it is transferred and fused, i.e., transfused, as a print image to a sheet. Effective powder pick up and release is obtained in the printing apparatus with a transport member having an elastomeric layer of a softness which conforms to a receiving member of characteristic surface roughness, and a non-tacky outer coating which is harder than the elastomeric layer. The outer coating is thin enough to conform to the surface roughness, but hard enough to prevent entrainment of toner particles. A powdered filler allows a single thin belt to serve as the imaging element, i.e., as the latent and developed image carrier, as well as the element which transfers and fuses toner to a print. A duplex system employs two belt-imaging members which each travel over one of a pair of opposed pressure rollers having identical elastic characteristics.

40 Claims, 4 Drawing Sheets

POWDER TRANSPORT, FUSING AND IMAGING APPARATUS

BACKGROUND

The present invention relates to improvements in mass transport systems, and to such systems wherein a discrete quantity of material is moved from a first location maintained at a first temperature, to a second location maintained at a different temperature. It relates in particular to systems such as a printing system wherein an imageor color-forming material of slight mass is carried to a second location of higher temperature where it is fused to a receiving medium.

In the field of photocopying or printing, it is known to print by first forming an electrostatic latent image on a photoconductive drum or belt, developing the electrostatic latent image on the drum with a toner, and then transferring the toner to a moving belt which carries the toner past a heat fusing station where the toner is melted and transferred to paper or some other print medium. Systems of this type are shown in U.S. Pat. Nos. 3,893,761; 3,923,392; and 3,947,113. Such a system has been made and marketed commercially.

In the commercial system known to applicant, the primary function of the belt is to provide a transport mechanism to carry the developed toner image to a high temperature fusing and transfer station. The belt is a relatively thick belt, e.g., one or more millimeters thick, that is operated isothermally at a temperature over 100° Celsius which is sufficient to fuse the transported toner. In such a construction, the belt serves to isolate the primary latent-image forming member, which is a photoconductive belt, from the high fusing temperatures; this allows the photoconductive belt to operate with a conventional powdered toner image development technology.

Such construction results in a complex assembly wherein a first image forming and toner transport mechanism is operated at one temperature, and a comparably large transport assembly is maintained at a higher temperature within the machine. The machine requires a significant power input for its heated portion, and is mechanically complex. The transfer of toner between two or more intermediate members adds considerations of image quality.

Accordingly, it would be desirable in systems of this sort to simplify the mechanical structure, reduce the power requirements, and improve the image transfer characteristics.

SUMMARY AND OBJECTS OF THE INVENTION

It is an object of the invention to provide a thermally efficient transport between two locations at different temperatures.

It is another object of the invention to provide a transport member having effective pick up and release properties.

It is another object of the invention to provide an efficient image forming apparatus wherein a latent image is developed with a toner powder at one location and the developed image is transferred and fused to a sheet to form a print at a second location.

These and other desirable qualities are achieved in one aspect of the invention by a printing system wherein a transport member, illustratively an endless belt, moves between an unheated location where it picks up particles, and a heated location where the particles are melted and transferred to a sheet to form a print. The belt has a low thermal mass and portions of the belt moving in opposite directions between the heated and unheated locations are maintained in proximity so that they exchange heat. This reduces the energy required to bring each portion of the belt about each location into thermal equilibrium with that location, reducing the amount of energy lost due to thermal cycling of the belt. In another aspect of the invention, the transport member has a multi-layer structure with a sublayer and a surface layer. The sublayer is an elastomeric layer of a softness which yields at low pressure to effectively conform at a dimension characteristic of a print surface of a fibrous roughness, and the surface or outer layer which is formed of a material which is hard at spatial frequencies below that characteristic dimension. In one preferred system, a charge deposition print head structure deposits a charge distribution on the belt member to form an electrostatic latent image. In this embodiment, a dielectric filler material may be added to the material of at least one layer to achieve a belt capacitance of 50–250 pF/cm$^2$, and the outer coating layer enables a single imaging member to achieve both toner pick up and release for image formation and printing.

DETAILED DESCRIPTION

Figure 1:
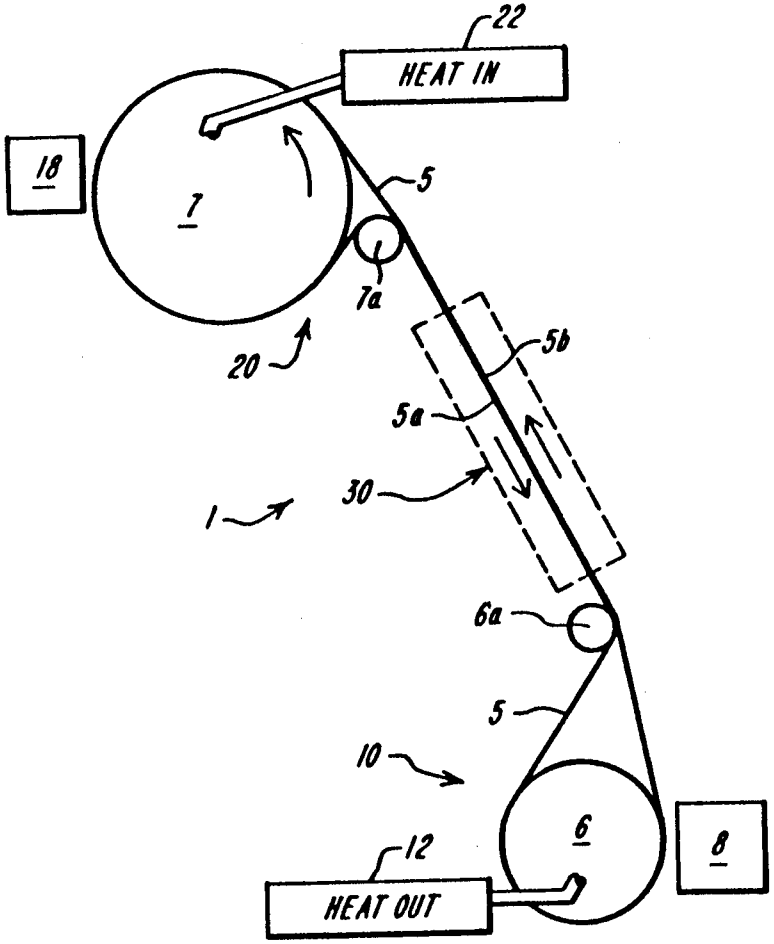
FIG. 1 shows a schematic view of a thermal transport system according to the present invention.

FIG. 1 illustrates in schema a principal aspect of the present invention, wherein an apparatus 1 moves a discrete mass of material between a first location 10 maintained at a first temperature, and a second location 20 maintained at a different temperature, through an intermediate region 30.

In the illustrated embodiment, location 10 is a "cold" location, with its temperature range maintained in a preset operating range by a cooler or ventilator 12, and location 20 is a "hot" location, maintained at a higher temperature by a heater 22. Cooler 12 and heater 22 may be omitted in applications where process conditions at the respective locations, such as a continuous influx of cool or hot material, provide the appropriate heat level. Further, the relative positions of the hot and cold locations may be interchanged, so long as there are two process locations maintained at differing temperatures.

A belt member 5 suspended over rollers 6, 7 at locations 10, 20 respectively, moves in a cyclic manner between the two locations, carrying material which is deposited on the belt 5 by a material deposition unit 8 at one location. The material is received by a material receiving unit 18 at the other location, having undergone a temperature change corresponding to the difference between the depositing and receiving environments.

According to a principal aspect of the invention, a thermal shunt is provided between counter-moving hot and cold portions of the belt to diminish the amount of heat transported from the hot region of the apparatus. This is achieved by having oppositely moving portions of the belt 5*a*, 5*b* thermally contacting each other, in a region 30 between locations 10 and 20, so that they exchange heat. A pair of path-defining idler rollers or shoes 6*a*, 7*a* maintain the desired belt path. As illustrated, the cold-to-hot moving belt portion 5*b* which carries deposited material, receives heat from the hot-to-cold moving belt portion 5*a*. This counterflow heat exchange raises the temperature of portion 5*b* and the material it carries, while lowering the temperature of the empty return portion 5*a*. The heat capacity, thermal conductivity, belt thickness length of heat exchanger and belt speed are selected to allow effective heat transfer between the counter-moving belt portions, so that only a small amount of heat is transported to location 10. This construction reduces the amount of energy lost by unwanted energy transport between the two locations, and reduces the amount of energy required to maintain the operating temperature of each of the locations.

Figure 2:
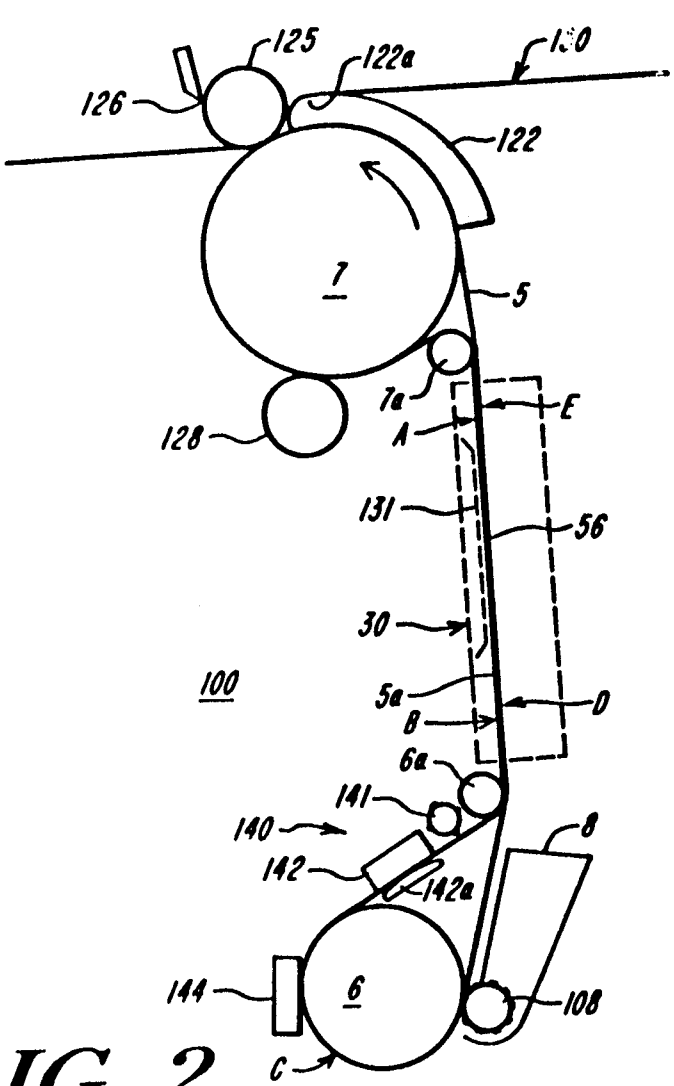
FIG. 2 shows a view corresponding to FIG. 1 with further details of construction in an embodiment as a printing system.

FIG. 2 shows a printing or coating apparatus 100 employing the counterflow heat exchange transport system of FIG. 1. Corresponding elements are numbered identically, and are laid out in the same relative positions for clarity of exposition. The apparatus functions to deliver a heat fusible thermoplastic, e.g., a toner, to a heated station where it is transferred to a moving web or sheet 150.

In the illustrated apparatus, the belt 5 is a belt having a dielectric layer which is charged to form a latent charge image, and toner particles from a reservoir 8 are applied by a brush or other applicator 108 so that they adhere to the charged portions of the belt. The belt outer surface has a hard skin, so that the toner powder adheres only in the charged regions of the latent image. The adhered toner is transported to the heated station at roller 7 where an array of heaters within the roller as well as heater lamps 122 directed at the belt soften the transported toner. A paper web 150 is fed by a feed mechanism (not shown) and is preferably preheated (e.g., by the same heater 122 at shoulder 122*a*) before it is pressed at a relatively low pressure against he belt 5 by a print roller 125 to receive the softened toner therefrom. This results in a single-step mechanical transfer and fusing of the softened toner image to the paper. This "transfuse" step contrasts with conventional processes, wherein the transferred image is generally fused to the paper at a separate heating station.

A scraper 126 maintains the roller 125 clean, and a cleaner roller 128 having an absorbent or adhesive jacket contacts the belt to pick up any untransferred residual toner from the belt, so that the portion of the belt 5*a* leaving the heated roller 7 is clean. As in FIG. 1, knee rollers 7*a*, 6*a* preferably position the intermediate belt portions 5*a*, 5*b* in heat-exchange contact. A platen 131 (shown in phantom) of non heat conductive material and low thermal mass may urge the counter-moving belt portions into more intimate contact between the knee rollers. Alternatively, an intermediate plate of conductive low friction material, such as cast iron, may be placed between the two moving belt portions to conduct heat from one to the other in a thermal shunt.

After moving through the heat exchange region 30, the cleaned and cooled belt portion 5*a* passes to an electrostatic imaging area 140 where a corona discharger, e.g., a corona rod 141, erases the residual belt surface charge distribution. The belt then passes to one or more controllable print heads 142, 144 which selectively deposit an imagewise charge distribution on the moving belt so that toner next applied by applicator 108 will adhere to the belt with a spatial distribution corresponding to the desired image. In the prototype embodiment, the printhead 144 was an ionographic printhead of the general type shown in U.S. Pat. No. 4,160,257 and later patents. Printhead 144 may, however, comprise an electrostic pin array or other latent-image charge applying means.

The two latent image depositing printheads 142, 144 illustrate two different approaches to mounting a printhead in relation to the belt. Printhead 144 is opposed to the drum 6, creating an image deposition geometry similar to that of existing dielectric drum-based systems presently on the market. Printhead 142 is positioned opposite an anvil 142*a* against which the belt is urged. Anvil 142*a* is shaped to provide a desired surface flatness or curvature in order for the belt to faithfully receive the charge pattern formed by printhead 142. This latter construction reveals that the described dielectric belt system is adapted to generate latent charge images by the placement of plural electrostatic or ionographic printheads at arbitrary positions along the belt ahead of the toner applicator 8, 108. In practice a single printhead, e.g., printhead 144, is sufficient for single-tone or single-color printing.

The toner employed in the prototype was a magnetic dry powder toner with a meltable thermoplastic pigment material. Good results were obtained with the common Hitachi HI-TONER HMT201 heat fusing magnetic toner operating with a hot drum maintained at 165° Celsius and a belt speed of 38 cm/sec. This particular toner is compounded with a 10–30 micron particle size distribution. Similar single or multi-component fusible toners, such as a coates M7094/or RP1384 yield comparable results with drum temperatures in the range of 105° to 145° C. at this speed.

It will be observed that the system of FIG. 2 has several advantageous properties. First, after the toner passes heater 122 it is softened and is transferred and fused to the paper in a single step. Thus, unlike conventional systems wherein the transferred toner is carried on the sheet to a separate fusing station, there is negligible airborn toner dust released into the electrostatic image-generating region. Further, unlike a pressure-fixed toner, the heat-softened toner is transferred to the web 150 using a relatively low contact pressure, under approximately 100 psi, so that high pressure skew rollers, which could smear the image, are not necessary. The low pressure resilient rollers can transfer the image to relatively thick, rough/, heat-sensitive or electrically conductive substrates, thus providing a new process for forming patterns or images on such materials. Third, the heat-softened toner produces archival quality adhesion to the print. It is also observed that by using a single imaging element consisting of a belt, image registration between different stations is easily achieved. Furthermore, changes of printing speed may be effected without substantial modification of the mechanical transport mechanisms.

A belt suitable for the system 100 has two sets of characteristics. First, the heat capacity and heat-transfer characteristics are preferably such that effective counterflow heat exchange occurs at reasonable belt operating speeds. Second, the belt charging and toner pick-up and release properties are preferably such that a suitable latent charge image is formed, and that the belt effectively picks up and then fully releases the toner in each image cycle.

With regard to the thermal requirements of the belt, applicant has performed simulations and measurements to determine the energy requirements of a belt formed of different materials, such as an aluminized polyimide KAPTON film, an aluminized KAPTON film coated with PTFE, and a stainless steel belt. These simulations and experiments supported the conclusion that for thin belts (under approximately a millimeter thick) at belt speeds of 0.5–1.0 m/s, the thermal conductivity of the belt was less critical than the heat capacity of the belt material in determining the power exchanged in counterflow exchange path 30 and the power lost to the cool drum 6. Thus, stainless steel required several times as much power input at each belt speed, and coated polyimide performed less efficiently than the uncoated film.

Figure 3:
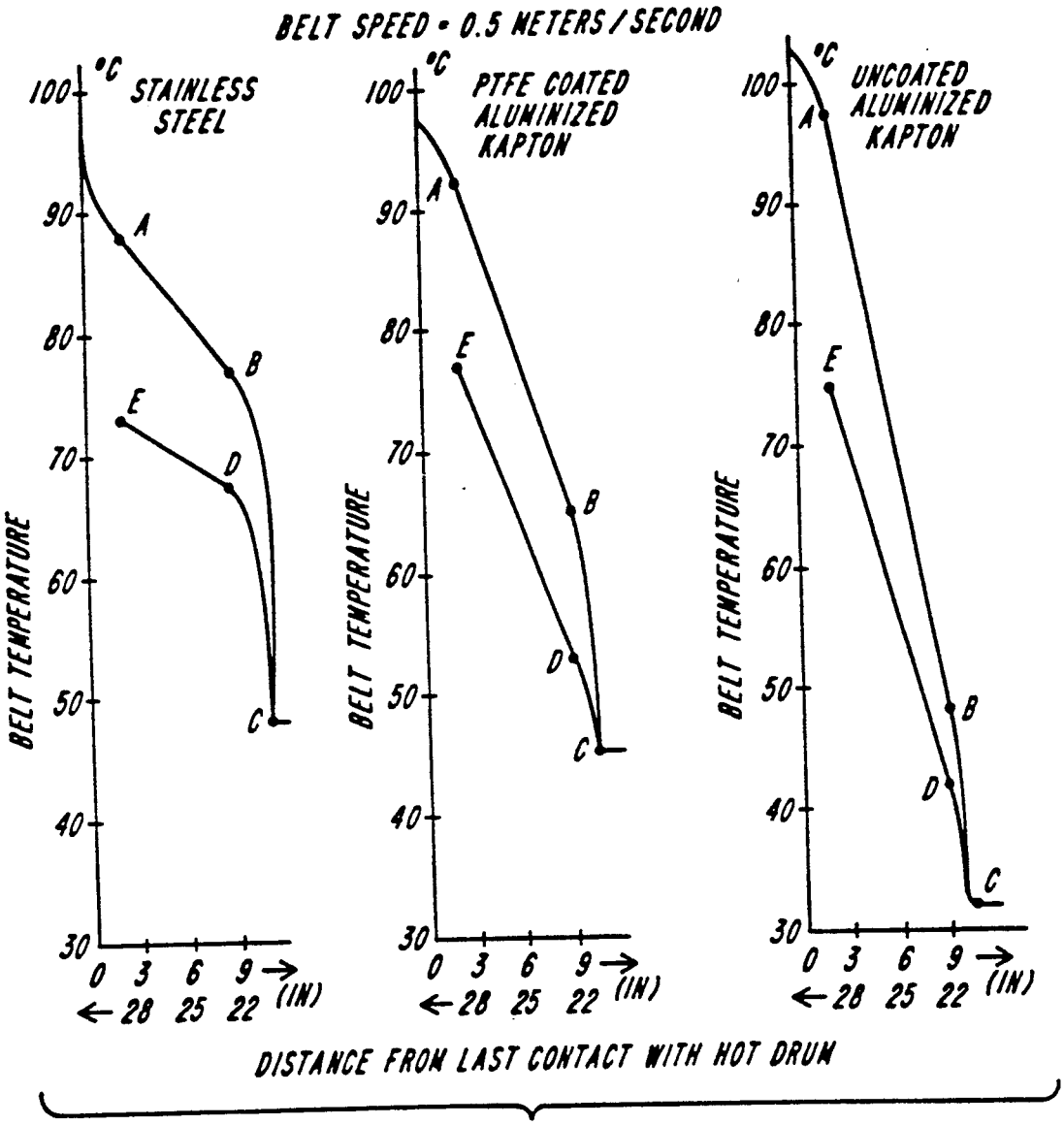
FIG. 3 shows thermal characteristics of different heat exchange belts.

FIG. 3 shows representative temperature readings taken on belts of the above materials having a length of approximately one meter and run on a test jig at a speed of approximately 0.5 m/sec. The temperature was measured at points A, B, C, D, E corresponding to those shown in FIG. 2, after an initial warm up period. As shown, the total heat transfer between portions of the belt, which is proportional to the difference $T_E$–$T_D$, and the power lost to the cold drum, which is proportional to the temperature difference TB–TC, are each significantly better with the uncoated Kapton belt. The stainless steel belt, because of its greater heat capacity, did not effectively reduce the excess hot side belt temperature. Similarly, the PTFE-coated belt was less effective at this belt speed due to its increased mass.

The belt speed of approximately 0.5 m/sec. is representative of a desirable speed for a printer to achieve a printing speed of one sheet or more per second. The ability of the countermoving belt portions to exchange heat and each reach a substantially uniform temperature through their thickness dimension depends on their thickness, specific heat, length of contact, belt speed and frictional forces. Applicant has found that a belt thickness of approximately 0.10 mm, and preferably in the range of 0.02–0.20 mm, provides effective transfer for the full thickness of the belt at a range of belt speeds of 0.1 to 2.5 m/sec. suitable for printing. A number of commercially available film or sheet materials, such as stainless steel, beryllium-copper, various forms of Kapton sheet, and other materials are all suitable belt materials, possessing the necessary tensile strength, heat mass and conductivity. At higher speeds optimal printing, materials with a lesser heat mass are superior. Higher thermal conductivity does not markedly affect the heat transfer over the range of small belt thicknesses contemplated.

In addition to these physical parameters, applicant has found that when the facing layers of the belt are formed of a dielectric material, so that they accumulate charge, then a measurable improvement in heat transfer characteristics occurs due to the opposing belt portions being drawn into more effective thermal contact by electrostatic attraction between the oppositely moving portions of the charged belt. An assymmetry in the locations of roller placement or the like is sufficient to cause the necessary difference in triboelectric charging of the two counter-moving belt portions which establishes such attraction. Preferably the belt is somewhat conductive to prevent excessive static charge build up that increases the mechanical drag of the belt.

The second aspect of belt construction which is important to the operation of the thermoplastic printing apparatus 100 relates to the toner pick-up and release characteristics of the belt. These attributes will be discussed with reference to the above-described printhead structure, which, in accordance with general principles known in the literature, operates by depositing a latent image charge on a dielectric member such that a charge up to several hundred volts is deposited at a point of the member for attracting toner particles to the dielectric member.

For such operation, applicant has employed a belt with a capacitance of approximately 125 to 225 pf/cm$^2$, and considers a preferred range for other common charging and toning systems to be 50 to 500 pf/cm$^2$. For certain systems, such as one with a stylus-type charging head, a belt capacitance of approximately 1000 pf/cm$^2$ may be desired, and for other systems operation with a belt capacitance as low as 10 pf/cm$^2$ may be feasible. The construction of a preferred belt having a capacitance of 125–225 pf/cm$^2$ falling within such capacitance range is discussed in greater detail below, following consideration of toner release characteristics.

Applicant has found that transfer members which conform adequately to a paper surface for full transfer of an image present a technical problem for the development of a latent image with powdered toner. The outer skin of the belt is preferably of a hard material, in order to assure that powdered toner is attracted to and maintained at only those regions bearing a latent image charge. Applicant has further found that microscopic voids appear in the transferred image and correspond to irregular surface features in the paper or print medium. Thus, paper fibers, grit and surface features having a dimension of approximately 0.01 mm characteristic of the surface roughness of a paper surface may prevent the full transfer of toner when the heated toner-bearing belt is pressed against a sheet.

These two problems are overcome by providing on the belt an elastomeric layer of a sufficient softness to conform to the rough paper surface, and by covering the elastomeric layer with a hard surface coating. The hard coating is sufficiently thin to still allow the belt surface to conform to the rough paper surface, but is hard enough to assure that the belt surface does not conform to substantially smaller features, and does not entrain paper dust or toner particles.

The hard coating is sufficiently hard to prevent surface conformance to features of 100 Angstroms or less, and thus prevents the van der Waals molecular attractive forces from acting on a toner particle over an area of intimate contact sufficient to adhere it to the belt.

On the other hand, when the toner is heat-softened or melted, and mechanical pressure is applied to transfer the toner to a paper or other material, applicant has found that a surface material having a low surface free energy enhances toner transfer since the low surface free energy material is abhesive. These several characteristics of the belt assure that the surface is not "tacky" and does not develop sufficient molecular attractive forces to retain toner in the absence of the applied latent image charge, or in the presence of the mechanical adhesion of the heated toner to paper.

By way of example, suitable elastomeric and hard coating properties may be obtained with an elastomeric layer approximately 0.05 mm thick formed on a Kapton belt with a silicone rubber of a 30 Shore A durometer, overcoated with a 0.005 mm thick layer of a polymer having a hardness of approximately 35–45 Shore D.

A suitable hard coating material is the silicone resin conformal coating material sold by Dow Corning as its R-4-3117 conformal coating. This is a methoxy-functional silicone resin in which a high degree of cross-linking during curing adds methoxy groups to elevate the overall molecular weight of the polymerized coating. Suitable materials for the belt substrate include 0.05 mm thick films of Ultem, Kapton or other relativey strong and inextensible web materials such as silicone-filled woven Nomex or Kevlar cloth, capable of operating at temperatures of up to approximately 200° C. Suitable conductive material is included in or on the substrate layer to control charging and provide a ground plane. Suitable elastomeric intermediate laYer materials include silicone rubbers, fluoropolymers such as Viton, and other heat-resistant materials having a hardness of about 20–50 Shore A.

Figure 4A:
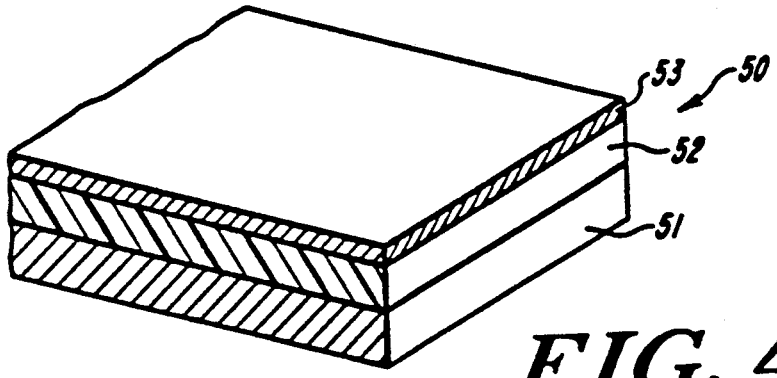
FIGS. 4A–4C show preferred layer structures for transport members suitable for the embodiment of FIG. 2.
Figure 4B:
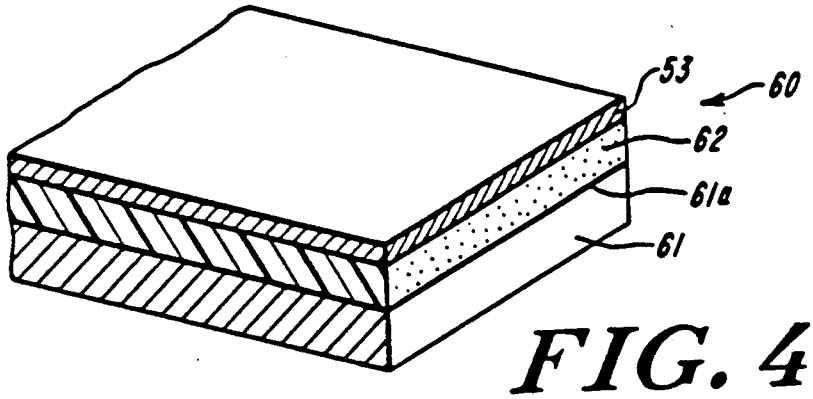
Figure 4C:
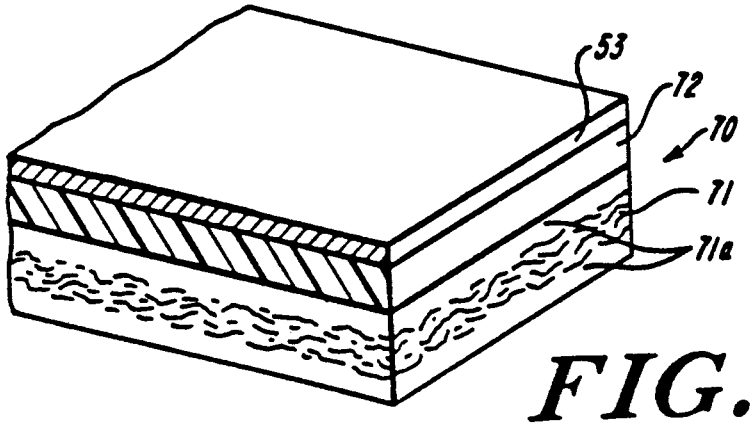

FIGS. 4A, 4B, 4C illustrate three different belt constructions illustrating a range cf features.

In FIG. 4A, a belt 50 includes an electrically conductive support 51 of 0.05 mm thick aluminized Kapton, having a 0.04 mm thick layer 52 of a silicone rubber overcoated with a hard skin coat 53 which is 0.005 mm thick. Layer 52 has a 35 Shore A durometer, whereas surface coat 53 has a 45 Shore D durometer. Because the various polymers have dielectric constants of between two and three, the multilayer construction is preferably modified by including a high dielectric filler material in at least one layer. The use of filler in this manner increases the hardness, and accordingly a thicker elastomer layer or a softer elastomer is used in such a construction to retain the desired surface conformability.

FIG. 4B shows such a filled belt construction, 60. In this embodiment, the substrate is formed of a 0.05 mm thick thermally conductive film 61 having a metalized face 61*a*, such as the MT film of Dupont. Elastomeric layer 62 is formed of a 0.05 mm coating of silicone rubber compounded by Castall, Inc. of Weymouth, Mass., loaded with a sufficient amount of barium titanate in a prepared formulation to achieve a dielectric constant of 13, and having a net hardness of about 40–45 Shore A. The hard skin outer coat 53 is identical to that of FIG. 4A. Other additives may be mixed in or substituted in order to adjust the belt capacitance, thermal conductivity or belt hardness. For example, a metal powder filler achieves high capacitance without excessive hardening.

FIG. 4C shows an alternative belt construction 70 wherein a low density woven fabric belt 71 is impregnated with a soft electrically conductive silicone rubber binder 71*a* to form a conductive layer 0.075 mm thick. A suitable rubber may have a 35 Shore A durometer, and electrical conductivity of $10^3$ ohm centimeters. In this case, the substrate is conformable, and the silicone rubber layer 72 may thus be quite thin since no additional softness is needed. For example, layer 72 may be formed with an elastomer of 30 Shore A hardness and a thickness of under 0.05 mm. Layer 72 is coated with a hard skin 53 as in the other examples. The layers 72, 53 are thus sufficiently thin to achieve a high capacitance without a filler.

In the last two above cases, the use of a conductive substrate allows the belt to be grounded by using grounded conductive rollers 6, 7 in the apparatus of FIG. 2.

When using the Dow corning R-4-3117 silicone resin coating material described above as the non-tacky surface coat, applicant has found that outer layers having a thickness of 0.0025–0.005 mm appear thin enough to allow the belt to conform to surface roughness features of 0.01 mm while being sufficiently hard to prevent toner entrainment. Surface layers thicker than 0.0075–0.01 mm appear too stiff to permit complete image transfer to a paper surface. In applying the hard surface coat, applicant employed a Mayer wire-wound rod as the applicator. For forming the intermediate elastomer layer, the silicone rubber was coated by a knife and roller assembly to create a smooth coating of uniform thickness.

Various modifications of the surface coating constructions indicated above are possible to achieve the desired surface properties. For example, to achieve a hard coat over the soft silicone rubber, one may treat the silicone rubber surface by nitrogen ion bombardment at ion energies of 50–100 KeV and a current of about 0.01 microamps/cm$^2$, with a dose of $10^{13}$ ions/cm$^2$. This provides a slippery hard surface which does not entrain toner powder. Another technique is to treat the elastomer coating by exposure to a plasma. Both ion-bombardment and plasma-reaction techniques are believed to promote cross linking of the surface material. Particular materials may be emploYed to achieve a desired degree of cross-linked polymerization. For example, a surface coat of a vinyl-dimethyl silicone rubber may be polymerized by electron beam radiation to provide the hard skin of appropriate thickness and hardness. The polymerization of the skin may also be controlled by ultraviolet, catalytic, corona or chemical polymerization techniques.

In any of these fabrication techniques, the substrate provides dimensional stability, while the substrate and subsurface layers together are selected to have sufficient softness to conform to a print member, such as metal sheet, paper or acetate, having a characteristic surface roughness, when urged by a pressure roller at a relatively low pressure of fifty to one hundred and fifty PSI. The elastic deformation of the belt coating must be commensurate with the intended surface roughness at this pressure. The hard surface coat is then formed to be sufficiently hard and thick to prevent entrainment of toner, while not being so hard or thick as to interfere with dimensional conformance of the surface. By using a surface coat of low surface free energy softened or melted toner does not adhere to the belt, and the toner transfers fully and completely to the print member when pressed. A surface free energy of 20 dynes/cm or less is desirable.

Figure 5:
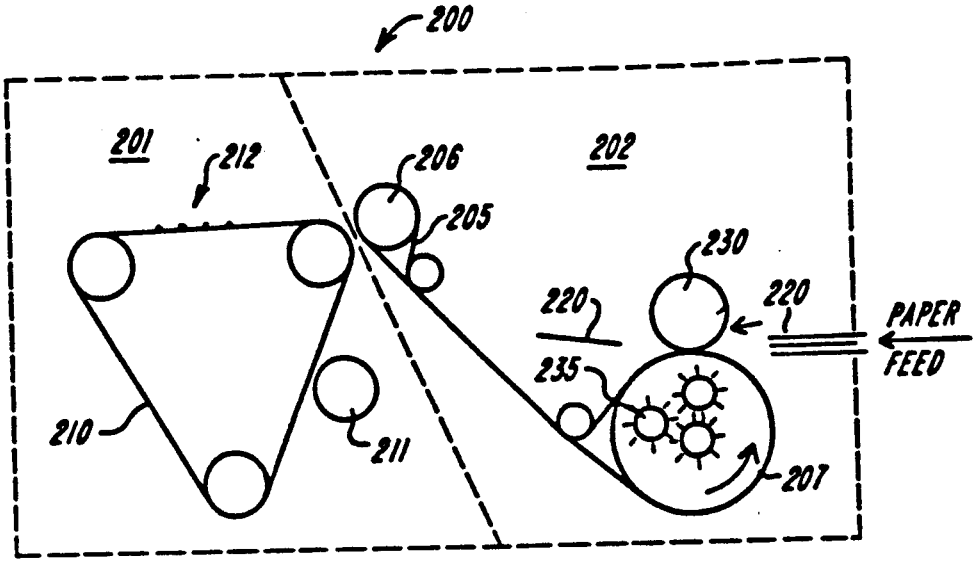
FIG. 5 shows an alternative system including features of the invention.

FIG. 5 shows an alternative embodiment of a printer 200 according to the invention, employing a transfer belt 205 with an elastomeric conforming layer and a hard skin. In this embodiment, a first section of the apparatus includes a latent image forming and toning section 201, and a second section 202 includes a developed image transfer and fusing belt 205. The section 201 is illustrated as including a belt 210 carrying a developed toner image 212. Alternatively, belt 210 may be replaced by a suitable image-carrying member such as a dielectric drum, dielectric plate or a photoconductive member. Section 201 may thus employ entirely conventional photocopying, laser printing or image-forming technology to form a toned image.

The second section 202 includes a transfer belt 205 which may, for example, have a belt construction similar to that illustrated in FIG. 4A, but may have a non-conductive substrate. Toner is transferred from the belt or drum 210 to the belt 205 by electrostatic charge transfer.

The transfer between members 210 and 205 may be effected either by corona charging the dielectric plastic belt 205, or by electrically biasing the roller 206 behind the belt at the toner transfer point. This transfers the toned image 212 from the original member 210 on which it was formed to the ultimate heat-transfer belt 205. The efficiency of toner transfer using this electrostatic method can be about 90 percent. Consistent electrostatic transfer between sections 201 and 202 takes place due to the lack of surface roughness and lack of variations in electrical conductivity of members 205, 210 of the type which are typically experienced in electrostatic image transfer to paper, and caused by humidity fluctuations. Portion 201 also includes an adhesive or similar cleaner roller 211 which contacts the dielectric imaging member 210 to remove the residual untransferred toner. As in the embodiment of FIG. 2, the belt 205 moves between its toner pickup point at roller 206 to a fusing station at roller 207 where the fused toner is transferred to a paper sheet or web 220 by pressure roller 230. Preferably, radiant heaters 235 within roller 207 provide the required level of heat input.

The hard skin overcoat of belt 205 decreases the likelihood of paper dust pickup onto this belt surface, and any dust which is present is expected to have little or no impact on the toner image transfer quality. This system is expected to enjoy a long belt life due to the hard skin coating, and thus to constitute an improvement over toner transfer sytems employing softer or adhesive-like belts.

Figure 6:
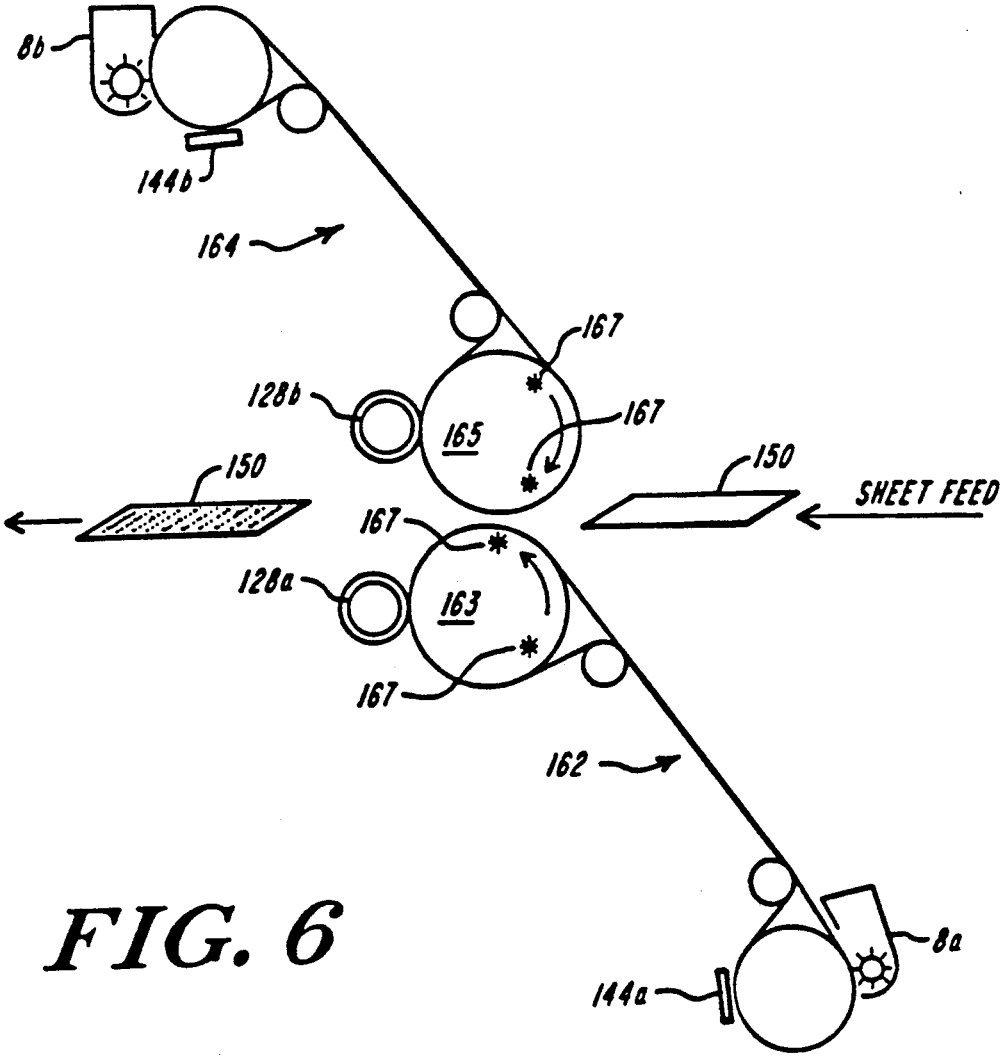
FIG. 6 shows a duplex system according to the invention.

FIG. 6 shows another system 160 according to the invention. In this embodiment, first and second substantially complete belt imaging systems 162, 164 are arranged such that each belt carries a toned image to one of the opposed rollers 163, 165, respectively, which each correspond to the roller 7 of FIG. 2. At rollers 163, 165, the two images are simultaneously transferred to opposing sides of a sheet 150. For clarity of illustration, the toner-softening heaters are illustrated by quartz lamps 167 Within the roller drums.

In this embodiment, rather than an arrangement of a drive roller 7 and a pressure roller 125 as in FIG. 2, each of the rollers 163, 165 is a belt drive roller and both have identical surface coating and elastic pressure properties, effective to produce a pressure of about 100–150 psi on a sheet of the desired thickness passing between the rollers. This assures that the transfer of toned image to each side of the paper is uniform. The opposed-belt arrangement of FIG. 6 also greatly simplifies the structure required for image alignment between the two sides of the duplex system, as compared to prior art duplex systems with multiple or serially-driven image transfer members. In fact, where the latent image is formed by an electrically driven charge deposition device 144 as described above, lateral and longitudinal shifts of the deposited image on one belt may be accomplished entirely eletronically by appropriate timing shifts introduced in the drive signals applied to the charge deposition device 144. Such timing adjustments may be performed automatically by a belt position detection device which monitors a series of registration marks placed by head 144 outside of the latent image bearing region of the belt.

This completes a description of representative embodiments of the several aspects of the present invention, which has been presented with different specific examples by way of exposition. It will be understood that the invention is not limited to the illustrated examples, but rather includes within its scope numerous modifications, adaptations, variations and improvements of the illustrated examples, as well as applications to systems other than those described.

The principles of the invention being thus disclosed, specific applications will occur to those skilled in the art, and are included within the scope of the invention, as set forth in the following claims.

What is claimed is:

1. An improved printing system of the type wherein a support member moves between first and second stations within the system, to transfer a toner image, wherein the improvement resides in that said support member includes a dielectric surface for receiving said electrostatic latent image and said toner, and wherein said dielectric surface includes a subsurface layer of an elastomeric softness effective to conform to an image-receiving print medium having a characteristic surface roughness, and a non-tacky surface layer of low surface free energy which coats said first subsurface layer.

2. The improved system of claim 1, wherein said surface layer has a hardness effective to prevent entrainment of toner particles, and is sufficiently thin to permit the surface to conform to the image-receiving print medium for effectively transferring toner from the support member to print an image.

3. The improved system of claim 2, wherein said surface is smooth and toner normally does not attach to it in the absence of a latent charge image of a voltage effective to cause toner to adhere.

4. The improved system of claim 3, wherein said support member includes a layer formed of an elastomer material which is loaded with a finely divided material to achieve a sufficient capacitance for forming said latent charge image.

5. The improved system of claim 3, wherein said support member is electrically conductive.

6. The improved system of claim 5, wherein said support member is an endless belt.

7. The improved system of claim 6, wherein the subsurface layer and the surface layer together have a capacitance in the range of 50–250 pf/cm$^2$.

8. The improved system of claim 7, wherein the endless belt has a body formed of a conductive elastomeric material and a high-tensile strength support which provides dimensional stability to said belt, and wherein said subsurface layer and non-tacky surface layer are formed of dielectric material which is sufficiently thin to achieve said capacitance range of 50–250 pf/cm$^2$.

9. The improved system of claim 7, wherein said belt is formed on a polyimide substrate and said subsurface layer includes a rubber.

10. An improved printing system according to claim 1, wherein said support member is a belt having a filler material incorporated therein for altering an electrical characteristic of the support member.

11. A transport member for transferring powdered material, such member comprising a substantially inextensible support member defining a closed circuit path,for unidirectional transport of powder between first and second locations, a first coating on the support member, said first coating having an elastomeric composition effective to conform to the surface of a print medium having a characteristic surface roughness, and an overcoating of release material defining an outer surface of said first coating.

12. A transport member according to claim 11, wherein said release material has a hardness greater than said elastomeric first coating.

13. A transport member according to claim 12, wherein said first coating includes a dielectric filler material.

14. A transport member according to claim 13, wherein said overcoating has a thickness of under approximately 0.1 mm.

15. A transport member according to claim 14, wherein said support member is formed of an electrically conductive polyimide sheet material.

16. A transport member according to claim 12, having an effective capacitance between approximately 50–250 pf/cm$^2$.

17. A transport member according to claim 10, wherein said support member is an endless belt.

18. A transport member according to claim 17, wherein said overcoating of release material has a low surface free energy to promote release of toner.

19. A transport member according to claim 11, wherein at least one of said first coating and said over coating includes a filler material incorporated therein for altering an electrical characteristic of the member.

20. A system for the transport of a toned image between heated and unheated stations in an image forming apparatus, such system comprising a sheet or laminar transport member having a back surface and a front surface, said transport member including a dielectric material to pick up toner and form a toned image on said front surface, said transport member being formed in a closed loop, first and second motive assemblies for moving said closed loop to transport the toned image between said unheated station and said heated station, and means forming a contact thermal shunt between different portions of said back surface to reduce the transport of thermal energy as the belt moves between said stations.

21. A system for forming print images on two sides of a sheet member, such system comprising a first dielectric belt arranged in a closed loop extending from a first region wherein the first belt receives a first toned image, through a second region wherein the first belt travels over a first resilient roller to urge the first toned image against a sheet member for transferring the first toned image to the sheet member, a second dielectric belt arranged in a closed loop extending from a third region wherein the second belt receives a second toned image, through a fourth region wherein the second belt travels over a second resilient roller to urge the second toned image against a sheet member for transferring the second toned image to the sheet member, said first and second resilient rollers each having substantially identical resilient characteristics, and being aligned and opposed with each other such that a sheet member passed between the two rollers simultaneously receives said first and second toned images on opposed sides of the sheet member.

22. A system according to claim 21, wherein said first dielectric belt is charged with a latent image and toned at said first region to form said first toned image, and said second dielectric belt is charged with a latent image and toned at said third region to form said second toned image.

23. A system according to claim 21, further comprising heater means, at said second and fourth regions, for heating the first and second toned images to a softened state so that the toned images are pressure transferred and fused to the sheet member as it passes between the two rollers.

24. A system according to claim 23, further comprising means associated with each belt, for providing a thermal shunt between different portions of the belt to reduce the amount of heat energy transported away from said heater means.

25. A system according to claim 21, wherein each said belt has a multilayer construction including a subsurface layer which is sufficiently soft to conform when pressed against a sheet member of characteristic surface roughness, and a surface layer which covers the subsurface layer and is formed of a non-tacky hard material sufficiently thin to also conform to said surface roughness.

26. A system for transporting material between first and second locations having a temperature difference therebetween, such temperature difference being effective to change a physical characteristic of the material from a powder to a pressure fusible state, wherein the system comprises an endless belt forming a rotating transport loop between said first and said second locations, first means for applying the material as a powder to said belt at said first location, second means for removing from the belt the material applied bY the first means in said pressure fusible state at said second location, said endless belt having a first portion of the loop travelling in a first sense for transporting the material from said, first to said second location, and having a second portion of the loop travelling in a second sense constituting a return portion of the loop, said first and second portions of the belt being positioned to face each other in contact while the belt is rotating so as to exchange heat between said first and second portions bringing the portion of said belt arriving at a said location to the approximate temperature of the said location, thereby diminishing energy loss to said rotating belt.

27. A system according to claim 26, wherein said material is a heat fusible powder and said second location is sufficiently hotter than said first location to soften the powder applied to the belt.

28. A system according to claim 27, wherein said second means includes pressure-applying means for pressing a sheet member against said belt at the second location to transfer and fuse the softened powder to the sheet member.

29. A system according to claim 28, wherein said belt includes a dielectric material and said first means includes means for electrostatically adhering a quantity of powder to said belt.

30. A system according to claim 29, further comprising means for electrostaticallY drawing said first and second portions into contact, enhancing heat transfer therebetween.

31. A system according to claim 29, wherein said belt has a hard skin for non-attachment of powder in regions of the surface which are not electrostatically charged.

32. A system according to claim 31, wherein said belt includes a first layer of material of a sufficient softness to conformally contact a image-receiving member having a characteristic surface roughness to effectively fully transfer powder thereto, and further includes a second belt layer forming an outer coating over said first layer and effective to prevent entrainment of powder by the belt.

33. A system according to claim 32 which is a printer, wherein said powder is a toner.

34. A system according to claim 33, wherein said coating is a non-tacky coating formed of a material having a hardness greater than approximately 20 Shore D, and is sufficiently thin that said outer surface contacts the image receiving member with a dimensional conformance of approximately $10^{-2}$ mm when said pressure applying means applies a pressure of approximately 100–150 psi.

35. A system for printing an image on a sheet, such system comprising a housing an endless dielectric belt having an imaging surface and a conductive layer below said imaging surface, said belt, being serially movable between first, second and third locations within the housing, means for forming an imagewise charge distribution constituting a latent image on said imaging surface at said first location, means for applying toner at said second location so that it electrostatically adheres to said dielectric belt in accordance with said imagewise charge distribution, and means for contacting said dielectric belt with a sheet at said third location to receive the toner therefrom, wherein said toner is a heat-fusible toner and said third location is maintained at a temperature to soften the toner so that the toner is effectively transferred from said dielectric belt to said sheet in a softened state in a single step by the application of pressure.

36. A system according to claim 35, wherein said belt comprises a dimensionally-stable support substrate, an elastomeric layer on said substrate, and a non-tacky surface layer over said elastomeric layer.

37. A system according to claim 36, wherein said elastomeric layer includes an elastomer and a powdered filler material having a dielectric constant substantially higher than that of said elastomer.

38. A system according to claim 37, further comprising means for heating the sheet prior to contacting the dielectric belt, whereby softened toner is wicked by said sheet from said belt to form a print image adhering to the sheet.

39. A system according to claim 38, further comprising means for maintaining oppositely travelling portions of said belt in contact so that they exchange heat in passing between said second and third locations.

40. A system according to claim 35, further comprising a thermal shunt for transferring heat energy between portions of said belt.

* * * * *

UNITED STATES PATENT AND TRADEMARK OFFICE

CERTIFICATE OF CORRECTION

PATENT NO. : 5,012,291

DATED : April 30, 1991

INVENTOR(S) : William R. Buchan et al.

It is certified that error appears in the above-identified patent and that said Letters Patent is hereby corrected as shown below:

Column 3, line 50, after "against" please delete "he" and insert --the--.

Column 4, line 43, please delete "coates" and insert --Coates--.

Column 7, line 22, please delete "laYer" and insert --layer--.

Column 7, line 27, after "range" please delete "cf" and insert --of--.

Column 8, line 33, please delete "emploYed" and insert --employed--.

Column 9, line 50, please delete "Within" and insert --within--.

Column 12, line 42, please delete "bY" and insert --by--.

UNITED STATES PATENT AND TRADEMARK OFFICE

CERTIFICATE OF CORRECTION

PATENT NO. : 5,012,291

DATED : April 30, 1991

INVENTOR(S) : William R. Buchan et al.

It is certified that error appears in the above-identified patent and that said Letters Patent is hereby corrected as shown below:

Column 12, line 46, after "from said" please delete --,--.

Column 13, line 2, please delete "electrostaticallY" and insert --electrostatically--.

Signed and Sealed this

Twentieth Day of April, 1993

*Attest:*

*Attesting Officer*

MICHAEL K. KIRK

*Acting Commissioner of Patents and Trademarks*